United States Patent [19]

Kiuru

[11] Patent Number: 4,501,643

[45] Date of Patent: Feb. 26, 1985

[54] APPARATUS FOR CUTTING AND GUIDING THE MARGINAL LEAD-IN STRIP OF PAPER WEB

[75] Inventor: Rainer Kiuru, Jyväskylä , Finland

[73] Assignee: Valmet Oy, Finland

[21] Appl. No.: 378,018

[22] Filed: May 13, 1982

[30] Foreign Application Priority Data

May 15, 1981 [FI] Finland ..... 811513

[51] Int. Cl.[3] ..... D21F 1/36; D21F 2/00

[52] U.S. Cl. ..... 162/286; 162/193

[58] Field of Search ..... 162/255, 286, 193, 194, 162/195

[56] References Cited

U.S. PATENT DOCUMENTS 1,338,094 4/1920 Pope ..... 162/193
1,688,267 10/1928 Cram ..... 162/193
3,355,349 11/1967 Devlin ..... 162/255

FOREIGN PATENT DOCUMENTS 1530874 11/1978 United Kingdom .

*Primary Examiner*—Steve Alvo
*Attorney, Agent, or Firm*—Steinberg & Raskin

[57] ABSTRACT

Apparatus for cutting and guiding the marginal or lead-in strip formed in a paper web and used in connection with a lead-in operation thereof includes first and second guide plates extending at an angle relative to each other and with which are associated nozzle tubes in which nozzle apertures or the like are formed for directing air jets parallel to the first and second guide plates. The first guide plate is oriented so as to correspond to the direction in which the end of the paper web is to be conducted onwardly after severance of at least the forward portion of the lead-in strip. The second guide plate is oriented in a direction which corresponds to that in which the marginal or lead-strip is conducted into a pulper or the like. Air jets are directed from the nozzle apertures over the respective guide plates so that the latter act as guiding and air transport surfaces so that the marginal lead-in strip is pulled in different directions in the area of the guide plates until it is severed. The new end of the web or marginal lead-in strip is conducted onward under the guidance of the first guide plate. A guide plate element is preferably provided forming a continuation of the first guide plate in order to guide the new end of the web or marginal strip onwards to subsequent guiding apparatus.

15 Claims, 7 Drawing Figures

APPARATUS FOR CUTTING AND GUIDING THE MARGINAL LEAD-IN STRIP OF PAPER WEB

BACKGROUND OF THE INVENTION

The present invention relates generally to paper machines and, more particularly, to apparatus for cutting and guiding the marginal lead-in strip formed in a paper web in connection with a lead-in operation.

Generally, cutting and guiding apparatus include nozzle tubes adapted to be connected to a source of compressed gas, nozzle apertures or the like formed in or on the nozzle tubes, and plates for guiding the passage of the lead-in strip.

The apparatus of the present invention is intended for use at locations in a paper machine where the introduction or "lead-in" of the web is accomplished by separating a narrow strip from the margin of the full-width web and conducting this so-called lead-in strip forwardly in the machine direction by means of jets of compressed air. The lead-in strip generally has a transverse dimension of between about 150 to 500 mm. This technique is utilized, for example, in connection with the transfer of the web from the last drying cylinder of the paper machine to the machine calendar or from the bottom roll of the calendar to the paper reeling apparatus.

When introducing or leading-in a web at the web transfer points using conventional techniques, the problem has been that when the separated marginal or lead-in strip, separated from the web in the manner described above, is first allowed to "flow" into a paper broke handling apparatus, i.e., the so-called pulper situated beneath the paper machine, whereupon the strip is then directed forwardly, e.g. into a first calendar throat or into the throat between a Pope cylinder and a tambour iron, that portion of the strip which has already travelled towards the pulper will also be lifted thereby tending to significantly slow down the lead-in operation due to the weight of this portion of the lead-in strip. Moreover, the paper web arriving at the throat of the next nip will be double folded, i.e. folded upon itself, which is extremely detrimental in that the rate at which the web is forwardly directed decreases thereby considerably increasing the difficulty encountered in inserting the lead-in strip between the subsequent rolls.

Attempts have been made in the prior art to avoid the drawbacks discussed above by constructing various mechanical conveyors to transport the marginal lead-in strip such, for example, as from a drying cylinder to the calendar. However, such arrangements are relatively expensive as compared to guiding the marginal strips by means of air jets and, moreover, do not reliably prevent the paper strip from arriving at the subsequent nip in a double-folded configuration.

Regarding the state of the art to which the present invention pertains, reference is made to Finnish Pat. No. 52478 (Great Britain Pat. No. 1,530,874) of the assignee of the instant application in which means are disclosed for facilitating the conduction of the web end in a paper machine. Such means comprise a chopper disposed at the transfer point of the marginal strip and adapted to cut the lead-in strip of the web into pieces prior to its conduction into the pulper while leaving an intact portion of the lead-in strip which has a length which is only sufficient to accomplish a further conduction using compressed air jets or the like. Thus, the lead-in strip provided by the apparatus of this Finnish patent is relatively short and light so as to be easily controlled and transferred by means of air jets and which can be transported to the next subsequent nip in an unfolded fashion so that the strip can be easily guided into the throat defined by the rolls. However, this arrangement has the drawback that it is relatively complex in construction and that the chopper has sharp saw blades which, of course, introduce safety problems in its operation.

Further regarding the state of the art to which the present invention pertains, reference is made to U.S. Pat. No. 3,355,349, in which cutting means in the form of a saw blade-like stationary member is situated at the lower margin of the lead-in strip guiding plate. As noted above, such blade-like members introduce safety risks into the operation of the paper machine and their operation is not always reliable.

SUMMARY OF THE INVENTION

Accordingly, it is an object of the present invention to provide new and improved lead-in strip guiding and cutting apparatus.

Another object of the present invention is to provide new and improved lead-in strip guiding and cutting apparatus wherein no moving parts or cutting blades are required.

Briefly, in accordance with the present invention, these and other objects are attained by providing apparatus for separating at least a forward portion of the marginal lead-in strip of a paper web from the web and for guiding the separated portion of the strip and the web thereafter which includes a first guide plate with which a first nozzle tube is associated which has nozzle means, such as nozzle apertures or a nozzle slit, formed therein for directing jets of gas, such as air, substantially parallel to the first guide plate. Similarly, a second guide plate is provided with which a second nozzle tube is associated and in which nozzle means are formed for directing gas jets substantially parallel to the second guide plate means.

The first and second guide plates are oriented such that their planes define an angle with respect to each other with the first guide plate being oriented in a direction which corresponds to the direction in which the new end of the marginal strip or web is to be further conducted while the second guide plate is oriented in a direction which corresponds to the direction in which the severed marginal strip is conducted to the pulper or the like.

The guide plates are arranged such that the air jets which are directed substantially parallel with respect thereto act as guiding and air transporting surfaces. Thus, the air jets directed over the respective guide plates pull the marginal lead-in strip in different respective directions whereupon the marginal strip is severed by rupturing at a region between the guide plates or at the nozzle apertures.

The new end of the paper web or marginal lead-in strip obtained after the cutting of the lead-in strip is then conducted under the guidance of the first guide plate.

It is seen from the foregoing that the present invention provides cutting and guiding means for the marginal lead-in strip of a paper web which has no moving parts and which does not require any sharp cutting edges in its operation. Another advantage is the relatively low space requirements necessitated by the cutting and guiding means and the fact that the same can be mounted on existing apparatus as a supplementary unit.

Another important advantage is obtained in that good control of the lead-in strip is retained during the cutting operation.

The lead-in strip cutting and guiding apparatus of the present invention may be utilized in connection with paper machine press sections, in connection with the last drying cylinder of the drying section of a paper machine, in connection with calendars, in connection with Pope reelers and sizing presses as well as similar applications.

It is noted that the guiding and air transport surfaces defined by the air jets and respective guide plates operate in accordance with the so-called Coanda phenomenon.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DESCRIPTION OF THE PREFERRED EMBODIMENTS

Figure 1:
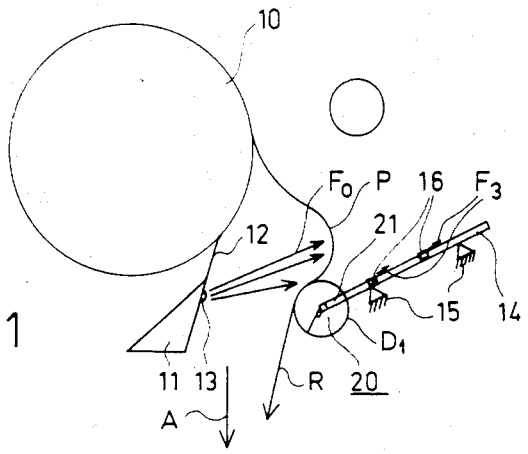
FIG. 1 is a schematic side elevation view of one embodiment of an apparatus according to the present invention, illustrated in conjunction with the last drying cylinder of the drying section of a paper machine.
Figure 2:
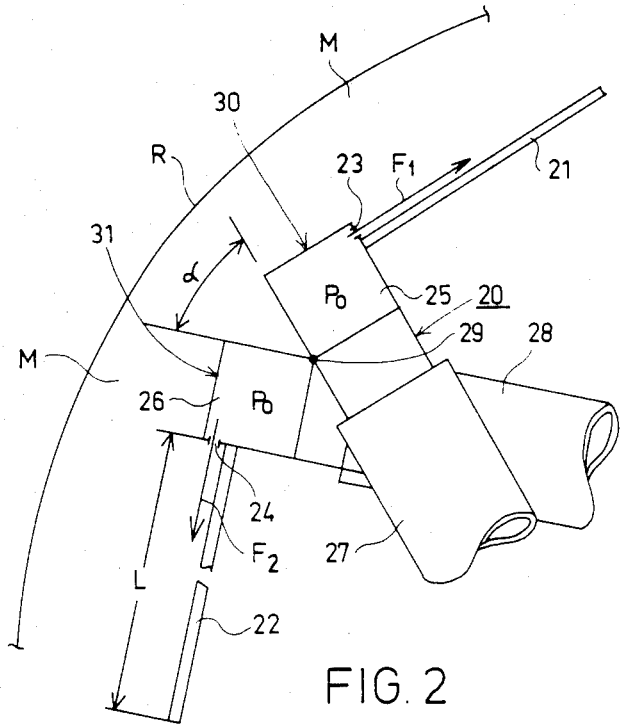
FIG. 2 is an enlarged detail view of the area designated $D_1$ in FIG. 1.
Figure 3:
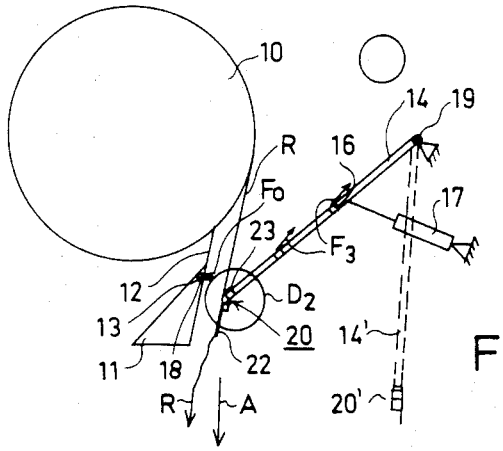
FIG. 3 is a view similar to FIG. 1 illustrating another embodiment of apparatus in accordance with the present invention, additionally adapted to operate as pick-up means.

Referring now to the drawings wherein like reference characters designate identical or corresponding parts throughout the several views, the apparatus illustrated in FIGS. 1–3 is shown in conjunction with the last drying cylinder 10 of a multiple cylinder dryer section of a paper machine, the cylinder 10 belonging to the upper row of the group of drying cylinders. Doctor means 11 provided with a doctor blade 12 is situated adjacent to the downwardly facing periphery of the drying cylinder 10. The doctor means 11 include compressed air jet means comprising an air tube 18 (FIG. 3) which is provided with a plurality of nozzle apertures 13 located in side-by-side relationship or with an equivalent narrow nozzle slit formed therein. The compressed air jet means comprising the air tube 18 and nozzle apertures 13 function to direct the lead-in strip, designated R, which has been separated from the margin of the paper web, towards the point where the web is to be introduced into subsequent apparatus and, in the illustrated embodiment, towards the first nip of a calendar. In this connection, the lead-in strip guiding and cutting apparatus of the present invention, described in detail below, facilitates such guidance of the lead-in strip.

Prior to the actual operation of the apparatus of the present invention, the lead-in strip R together with that portion of the paper web from which the strip R has been separated are conducted to the pulper, the direction in which the web is thus conducted being designated by arrow A in FIGS. 1 and 3. Since the distance from the air jet means 13, 18 of the doctor means 11 to the surface of the water in the pulper is generally about 4 to 5 meters, the weight of the portion of the strip R which is hanging from the cylinder 10 is quite high. Accordingly, as the air jets, designated $F_o$, emanating from the air jet means 13, 18 act on the strip R, the latter will assume a folded configuration, i.e., will be at least doubled over itself, with the air jet $F_o$ causing the lead-in strip to form a bight P (FIG. 1) upwardly and forwardly.

The embodiment of the guiding and cutting apparatus of the present invention illustrated in FIGS. 1–3 comprises an upwardly inclined guide plate element 14 carried by the frame structure of the paper machine at the points designated 15. The guide plate element 14 carries rows of nozzles 16 from which jets of gas, preferably air, are directed designated by arrows $F_3$ in the direction substantially parallel to the plane of the guide plate element 14. The cutting and guiding apparatus for the marginal lead-in strip R in the illustrated embodiment constitutes an extension of the lower margin of the guide plate element 14. More particularly, the apparatus comprises first guide plate means 21, the guide plate element 14 forming a direct continuation thereof. A first nozzle tube 25 extends along the transverse dimension at the lower margin of the first guide plate means 21. A plurality of nozzle apertures 23 are formed in side-by-side fashion in the first nozzle tube 25. In the illustrated embodiment, the nozzle tube 25 comprises a box-like element. Moreover, the nozzle apertures 23 may be replaced by equivalent structure, such as an elongated nozzle slit. Air is introduced into the nozzle tube 25 through a pipe 27 which is adapted to be connected to a source of compressed air.

A second nozzle tube 26 with which a second guide plate means 22 is associated is coupled to the first nozzle tube 25. The first and second nozzle tubes 25 and 26 may be integrally connected to each other or are preferably pivotally attached to each other by means of pivot pins 29 so that the angle $\alpha$ defined between the respective nozzle boxes can be selectively adjusted as discussed below. The second guide plate means 22 is inclined downwardly as seen in FIGS. 2 and 3. Nozzle apertures 24 (or an equivalent nozzle slit) open from the second nozzle tube 26 from which air jets $F_2$ are directed substantially parallel to and contiguous with the second guide plate means 22. Thus, the first and second nozzle tubes 25 and 26 are connected to a source of pressurized air (not shown) of which the pressure $P_o$ is selected to be sufficient high for the intended purpose.

The angle $\alpha$ defined between the normals of the planes of the first and second guide plate means 21 and 22 may vary within wide limits and may even be greater than 90° in certain applications. As noted above, the angle $\alpha$ can be selectively adjustable through the provision of the pivot axis 29 coupling the first and second nozzle tubes to each other. The guide plate means 21 and 22 have respective widths which are greater than or at least substantially equal to the width of the marginal strip R, viz, between about 150 and 500 mm. The length L of the guiding plate means in the direction of travel of the strip R is preferably about 100 mm. In the embodiment of the invention illustrated in FIGS. 1–3, the respective nozzle tubes 25 and 26 associated with the first and second guide plate means 21 and 22 are formed having cross-sections which are substantially in the shape of a rectangular prism. Thus, the nozzle tubes 25 and 26 associated with respective first and second guide plate means 21 and 22 have respective outer sides 30 and 31. These outer sides 30 and 31 of the nozzle tubes 25 and 26 also function as guiding elements as will become apparent below in the description of the operation of the invention. Moreover, it is possible, when desired, to fill the sector between the surfaces 30 and 31 with a filler plate.

The nozzle tubes 25 and 26 also have respective sides which are adjacent to the outer sides 30 and 31 and which are in substantially mutually opposed relationship to each other. In the illustrated embodiment, each of the first and second guide plate means 21 and 22 is affixed to an opposed side of a respective nozzle tube at a location which is spaced from the respective outer side thereof and the nozzle apertures (or slit) are formed in each of the respective nozzle tubes in the opposed side thereof in the space between the guide plate and the outer side thereof.

In order to obtain a proper functioning of the guiding and cutting apparatus of the invention, the size and spacing of the nozzle apertures 23 and 24 on the nozzle tubes 25 and 26 and the pressure $P_o$ of the air jets $F_1$ and $F_2$ are appropriately chosen. For example, in the case of the most common paper brands, the nozzle apertures have a diameter of about 1.6 to 2 mm, the pressure $P_o$ is about 4 to 6 bar (absolute) and the nozzle apertures 23, 24 of the nozzle tubes have a mutual spacing of about 5 to 15 mm.

The operation of the embodiment of the guiding and cutting apparatus illustrated in FIGS. 1–3 will now be described. The nozzle tubes 25 and 26 which direct the air jets $F_1$ and $F_2$ in substantially opposite directions are connected to a source of compressed air. By means of the air jets $F_o$ directed from the air jet means 13, 18 of doctor means 11, the marginal lead-in strip R is moved towards the guide plate means 21 and 22 and a subatmospheric pressure is created in the space designated M between the marginal lead-in strip R and the guide plate means 21 and 22. This subatmospheric pressure, resulting from the air jets $F_1$ and $F_2$, causes the marginal lead-in strip R to be urged towards the outer sides 30 and 31 of the nozzle tubes 25 and 26 and towards the guide plate means 21 and 22. This action continues until the marginal strip R reaches a certain position whereupon its movement ceases or until the strip R is situated opposite to the air jets being directed from one of the two sets of nozzle apertures whereupon the marginal strip R is severed by rupture. Such rupture is brought about by the momentum and friction forces of the air jets $F_1$ and $F_2$ opposed in direction.

Figure 4:
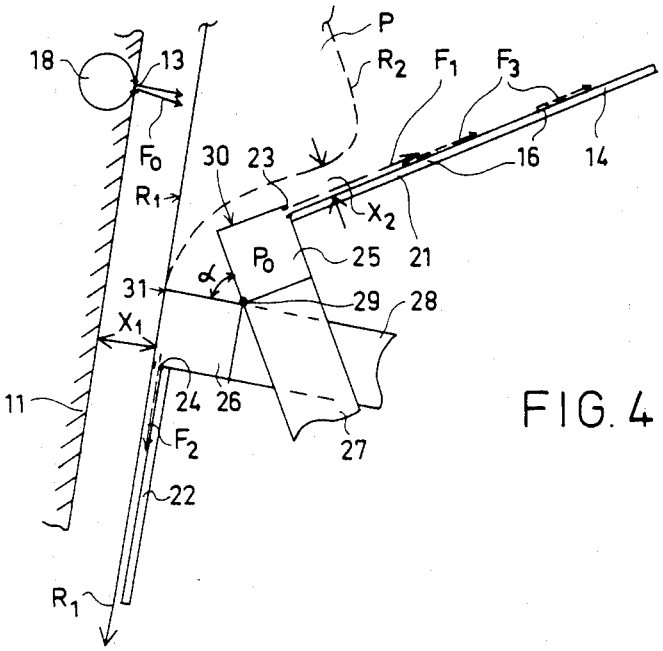
FIG. 4 is an enlarged detail view of the area designated $D_2$ in FIG. 3.

Referring now to FIGS. 3 and 4, an embodiment of the invention is illustrated which, in addition to functioning to cut and guide the lead-in strip of the paper web, also acts as pick-up means. The apparatus comprises a guide plate element 14 which is similar to the guide plate element 14 described above in connection with the embodiment of FIGS. 1–3, on the lower part of which the cutting and guiding apparatus 20 of the present invention is mounted. The guide plate element and the associated cutting and guiding apparatus of the invention are shown in FIG. 3 in phantom in their inoperative or inactive position and designated 14' and 20' respectively. The apparatus can be swiveled about a horizontally extending pivot rod 19 into an operating position shown by solid lines in FIGS. 3 and 4 by means of a hydraulic or pneumatic cylinder 17 or by any other suitable means for positioning the apparatus between the inactive and pick-up positions illustrated.

Referring to FIG. 4, the marginal lead-in strip, designated $R_1$, is shown as being guided at a distance $x_1$ from the guide surface of the doctor means 11 through the action of the second guide plate means 22 and air jets $F_2$ into the pulper. The portion of the marginal lead-in strip, designated $R_2$ and illustrated in dotted lines in FIG. 4, is acted upon by the air jets $F_o$ of the doctor blowing means 13, 18 to form a bight P at a distance $X_2$ from the first guide plate means. In this connection, it will be understood by those skilled in the art that the portion of the lead-in strip $R_2$ moves into the position illustrated in FIG. 4 wherein a part extends substantially parallel to the first guide plate means 21 through the action of the so-called Coanda effect produced by the air jets $F_1$.

The operation of the embodiment of the apparatus illustrated in FIGS. 3 and 4 will now be described. First the nozzle tube 26 is connected to a source of compressed air. The guide plate element 14 is pivoted from the inactive position (phantom in FIG. 3) to the pick-up position (shown by the solid lines in FIG. 3) by action of the cylinder 17. At this time, the marginal lead-in strip $R_1$ will be immediately drawn towards the surface of the guide plate means 22 under the Coanda effect produced by the air jets $F_2$ and will be held fast in this position. In this manner, the desired "pick-up" effect is achieved. Moreover, the marginal strip $R_1$ will be pulled to a taut condition between the cylinder 10 and the guide plate means 22.

At this time, the nozzles 16 mounted on the guide plate element 14 and the nozzle apertures 23 of the nozzle box 25 are connected to a compressed air supply. The air jets $F_o$ directed from the doctor blowing means 13, 18 act on the taut marginal strip $R_1$ and cause the same to obtain the position $R_2$ indicated by the dotted line configuration in FIG. 4. In this connection, the marginal strip $R_2$ is drawn by suction produced by the air jets $F_1$ so as to have a portion which is contiguous with the guide plate means 21. Through the application of opposed forces on the lead-in strip, the same is severed by rupture. The air jets $F_1$ and $F_3$ being directed from the nozzle apertures 23 and nozzles 16 carry the severed end of the lead-in strip towards the next guiding apparatus (not shown). The lower end of the marginal strip $R_2$ is guided by the guide plate means 22 to the pulper.

It is noted that the marginal strip R will not be ruptured at the nozzle tube 26 during the initial tensioning phase when it is pulled tautly between the cylinder 10 and the guide plate means 22 since the strip R falls under gravity while moving in the same direction with the air jet $F_2$.

Figure 5:
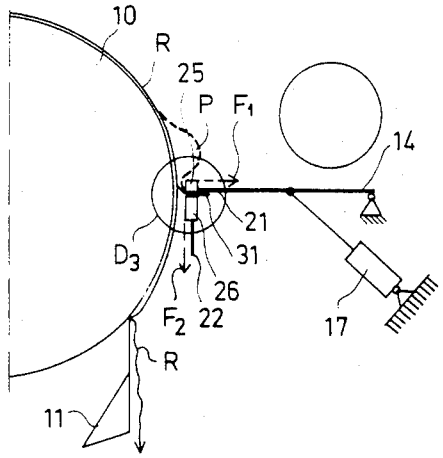
FIG. 5 is a schematic side elevation view of yet another embodiment of the present invention which incorporates marginal nozzle tubes on both sides of the marginal lead-in strip.
Figure 6:
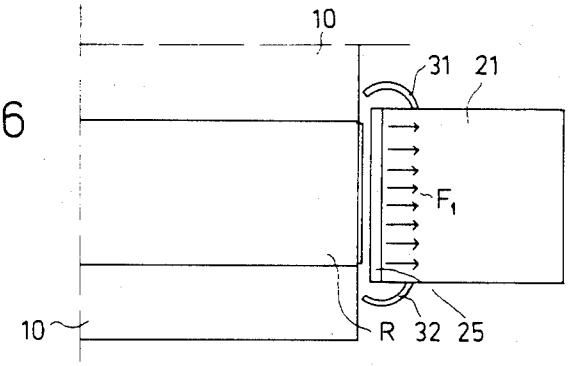
FIG. 6 is a top plan view of the apparatus illustrated in FIG. 5.
Figure 7:
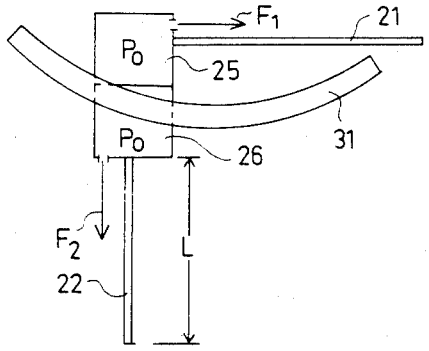
FIG. 7 is an enlarged detail view of the area designated $D_3$ in FIG. 5.

Finally, referring to FIGS. 5, 6 and 7, the embodiment of the apparatus illustrated therein is essentially similar to that discussed above in connection with FIGS. 3 and 4. However, in the embodiment of the invention illustrated in FIGS. 5–7, marginal nozzle tubes 31 and 32 are provided for directing air jets between the marginal lead-in strip R and the cylinder 10 on which it is supported. As seen in FIG. 5, when air jets are directed in this manner through the marginal nozzle tubes 31 and 32, the lead-in strip obtains a bag-like configuration P illustrated in dotted lines in FIG. 5. The air jets $F_1$ will draw the strip into contiguity with the first guide plate means 21 whereupon the marginal strip is severed in the same manner described above. In other respects, the operation of the embodiment of the invention illustrated in FIGS. 5–7 are similar to that which has already been discussed above.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. Apparatus for cutting and guiding a marginal lead-in strip which has been separated from a paper web in connection with a paper web lead-in operation on a paper machine, comprising:

first guide plate means with which a first nozzle tube is associated adapted to be connected to a source of pressurized gas, said first nozzle tube having nozzle means formed therein for directing gas jets substantially parallel to said first guide plate means;

second guide plate means with which a second nozzle tube is associated adapted to be connected to a source of pressurized gas, said second nozzle tube having nozzle means for directing gas jets substantially parallel to said second guide plate means;

said first and second guide plate means being attached to each other at an angle with respect to each other, the orientation of said first guide plate means corresponding to the direction in which the severed end of the lead-in strip is conducted after the lead-in strip has been separated from the web, and the orientation of said second guide plate means corresponding to the direction in which the lead-in strip is further conducted to a section of the paper machine;

wherein said guide plate means and respective nozzle tubes and nozzle means are arranged to operate as guiding and transporting surfaces so that gas jets directed from respective ones of said nozzle means of said first and second guide plate means pull the lead-in strip in respective opposed directions in the region of said guide plate means, whereupon the lead-in strip is severed by rupture in a region between said guide plate means or in a region between said nozzle means;

wherein said first guide plate means is arranged so that the new end of the lead-in strip obtained by the severing of the marginal strip is conducted therealong;

wherein said respective nozzle tubes associated with said first and second guide plate means are formed with respective outer sides and respective sides adjacent to said outer sides which are in mutually substantially opposed relationship to each other;

wherein each of said first and second guide plate means is affixed to an opposed side of a respective nozzle tube at a location which is spaced from the respective outer side thereof; and wherein said nozzle means are formed in each of said respective nozzle tubes in said opposed side thereof in the space between said guide plate means and said outer side thereof.

2. The combination of claim 1 further including a guide plate element forming an immediate extension of said first guide plate means, said guide plate element constituting means for guiding the new end of the web to subsequent guide means.

3. The combination of claim 2 wherein said guide plate element is provided with nozzle means for directing gas jets substantially parallel to said guide plate element to transport and guide the marginal strip subsequent to the guiding and cutting apparatus.

4. The combination of claim 1 further including means for positioning said apparatus from an inactive position to a pick-up position wherein the lead-in strip moves towards and into the guidance of said second guide plate means and with the lead-in strip being held taut, and further including gas jet means for producing a bight in the length of the lead-in strip while the same is held taut and being guided by said second guide plate means whereupon the marginal strip comes under the influence of the gas jets directed from the nozzle means of said first nozzle tube, whereupon the end of the marginal lead-in strip is severed by rupture in this manner with the severed end being conducted onwardly with the gas jet directed parallel to said first guide plate means.

5. The combination of claim 4 wherein said bight producing gas jet means comprise compressed air jet means associated with doctor means.

6. The combination of claim 1 wherein said nozzle tubes each have a cross-section substantially in the shape of a rectangular prism.

7. The combination of claim 1 wherein said nozzle tubes are coupled to each other by coupling means.

8. The combination of claim 7 wherein said coupling means comprise means for permitting a selective adjustment of said angle at which said first and second guide plate means are oriented with respect to each other.

9. The combination of claim 8 wherein said coupling means comprises a pivot pin having a substantially horizontally extending axis.

10. The combination of claim 1 wherein said apparatus further includes marginal nozzle tubes associated therewith adapted to direct a gas jet on at least one side of the lead-in strip whereby a blowing action is directed between the lead-in strip and a supporting surface underlying the same.

11. The combination of claim 10 wherein a pair of marginal nozzle tubes are provided, each being adapted to direct a gas jet on a respective side of the lead-in strip.

12. The combination of claim 10 wherein the gas jets directed on the lead-in strip by said marginal nozzle tubes cause the strip to obtain a bag-like configuration spaced from the supporting surface thereof, whereupon the lead-in strip is pulled by the gas jet directed from the nozzle tube associated with said first guide plate means whereby the marginal strip is severed.

13. The combination of claim 1 wherein said apparatus is disposed adjacent to doctor means, the latter being provided with gas jet means, and wherein apparatus to which the lead-in strip is to be guided, such as a pulper or the like, is situated on the opposite side of the lead-in strip from said doctor means.

14. The combination of claim 1 wherein said nozzle means comprise a row of nozzle aperture.

15. The combination of claim 1 wherein said nozzle means comprise a nozzle slit.

* * * * *